US007852059B2

(12) United States Patent
Ishii et al.

(10) Patent No.: US 7,852,059 B2
(45) Date of Patent: Dec. 14, 2010

(54) POWER SUPPLY DEVICE

(75) Inventors: Takuya Ishii, Osaka (JP); Mikio Motomori, Osaka (JP); Kazuhito Kimura, Kyoto (JP); Yoichi Deguchi, Osaka (JP); Satoshi Wada, Osaka (JP); Yoshihisa Minami, Shiga (JP)

(73) Assignee: Panasonic Corporation, Osaka (JP)

( * ) Notice: Subject to any disclaimer, the term of this patent is extended or adjusted under 35 U.S.C. 154(b) by 570 days.

(21) Appl. No.: 11/902,089

(22) Filed: Sep. 19, 2007

(65) Prior Publication Data

US 2008/0079410 A1 Apr. 3, 2008

(30) Foreign Application Priority Data

Sep. 29, 2006 (JP) ..... 2006-268698

(51) Int. Cl.
*G05F 1/40* (2006.01)

(52) U.S. Cl. ..... 323/284; 323/285; 323/222

(58) Field of Classification Search ..... 323/222, 323/282, 284, 351, 285
See application file for complete search history.

(56) References Cited

U.S. PATENT DOCUMENTS 7,148,668 B1 12/2006 Collins
7,274,116 B2 * 9/2007 Inoue et al. ..... 307/100
7,298,119 B1 * 11/2007 Summit et al. ..... 323/225
7,355,830 B2 * 4/2008 Motomori ..... 361/93.1
7,482,789 B2 * 1/2009 Motomori et al. ..... 323/224
2007/0085515 A1 * 4/2007 Nishida ..... 323/225

FOREIGN PATENT DOCUMENTS

JP 2003-319641 11/2003
JP 3593114 9/2004

* cited by examiner

*Primary Examiner*—Jessica Han
(74) *Attorney, Agent, or Firm*—McDermott Will & Emery LLP

(57) ABSTRACT

A power supply device includes an inductor controlled by switching to be charged or discharged such that a DC input voltage is boosted and a capacitor which smoothes the boosted voltage to generate a DC output voltage. Specifically, the power supply device further includes a transistor connected between the inductor and the capacitor to carry out a rectification function; an output voltage determination circuit which refers to the DC input voltage and the DC output voltage to determine the level of these voltages; and a current control circuit which controls a current flowing through the transistor such that the current has a predetermined value when the output voltage determination circuit determines that the DC output voltage is lower than the DC input voltage.

14 Claims, 3 Drawing Sheets

POWER SUPPLY DEVICE

CROSS-REFERENCE TO RELATED APPLICATIONS

This application claims priority under 35 U.S.C. §119(a) on Japanese Patent Application No. 2006-268698 filed on Sep. 29, 2006, the entire contents of which are hereby incorporated by reference.

BACKGROUND OF THE INVENTION

1. Field of the Invention

The present invention relates to a power supply device for supplying a DC voltage to various electronic devices and specifically to a power supply device which includes a step-up converter.

2. Description of the Prior Art

Step-up converters have highly-efficient power conversion characteristics and have been widely used in recent years as power supply devices in various electronic devices which operate on a battery used as a DC input power supply. A common step-up converter includes an inductor with an end connected to a DC input power supply, a switch connected between the other end of the inductor and a reference voltage node, a diode with an anode connected to the other end of the inductor, and a capacitor connected between the cathode of the diode and the reference voltage node. The inductor is charged/discharged by repeating turning on/off the switch, so that the voltage is boosted. The boosted voltage is accumulated in the capacitor and then output as a DC output voltage.

In the step-up converter having such a common structure, when the output side is short-circuited or overloaded, an overcurrent undesirably flows from the DC input power supply to the output side via the inductor and diode even if the switch is stopped such that the step-up operation is suppressed. Conventionally, to avoid damage to parts by such an overcurrent, a current detection resistor and a transistor for constant current control are inserted between the diode and output terminal of the step-up converter. When the current detection resistor detects an overcurrent, the transistor is controlled to have a constant current. With this feature, the output current is maintained constant even when the output side is short-circuited or overloaded. Thus, the inductor and diode are protected.

However, in the case of the aforementioned step-up converter having the overcurrent protection function, the current detection resistor and the transistor for constant current control need to be sufficiently resistant to a supply current which is supplied to a load in a normal operation. Insertion of the current detection resistor and the transistor for constant current control in a current supply route leads to occurrence of a conduction loss, which deteriorates the conversion efficiency of the step-up converter.

SUMMARY OF THE INVENTION

In view of the above, an objective of the present invention is to provide a step-up converter wherein the conversion efficiency is not deteriorated and the step-up converter is protected from an overcurrent caused by short-circuit or overload on the output side.

A solution brought about by the present invention for achieving the above objective is a power supply device including: an inductor controlled by switching to be charged or discharged such that a DC input voltage is boosted; a capacitor which smoothes the boosted voltage to generate a DC output voltage; a transistor connected between the inductor and the capacitor to carry out a rectification function; an output voltage determination circuit which refers to the DC input voltage and the DC output voltage to determine the level of these voltages; and a current control circuit which controls a current flowing through the transistor such that the current has a predetermined value when the output voltage determination circuit determines that the DC output voltage is lower than the DC input voltage.

With the above features, the current of the predetermined value flows through the transistor when the DC output voltage is lower than the DC input voltage without any additional element other than the inductor and the transistor which carries out a rectification function inserted in a current supply line extending from the input side to the output side. Therefore, an inrush current caused by startup and an overcurrent caused due to short-circuited load or overload are suppressed without occurrence of conduction loss or decrease of conversion efficiency, so that the respective parts can be protected.

Specifically, the current control circuit includes: a backgate control circuit which supplies the DC input voltage to a backgate of the transistor when the output voltage determination circuit determines that the DC output voltage is lower than the DC input voltage; an auxiliary transistor whose source and gate are respectively connected to a source and gate of the transistor; a constant current source connected to a drain of the auxiliary transistor; and a differential amplification circuit which receive a drain voltage of the transistor and a drain voltage of the auxiliary transistor to generate a voltage based on a difference between these received voltages and supplies the generated voltage to gates of the transistor and auxiliary transistor.

More specifically, the differential amplification circuit includes: an offset generation circuit which receives the DC output voltage and a predetermined voltage and which outputs a voltage equal to or higher than a lower limit of an operation voltage of the constant current source if the DC output voltage is lower than the predetermined voltage but outputs the DC output voltage if the DC output voltage is higher than the predetermined voltage; and a differential amplifier which receives the output voltage of the offset generation circuit and the drain voltage of the auxiliary transistor at an inversion input terminal and non-inversion input terminal, respectively, the differential amplifier having an output terminal connected to a gate connection point of the transistor and auxiliary transistor.

Preferably, the current control circuit gradually changes the current flowing through the transistor to reach the predetermined value. Specifically, the current control circuit has a resistor element connected between the gate connection point of the transistor and auxiliary transistor and the differential amplifier circuit. With these features, the current control provides gradual shift from the overcurrent state to the predetermined value, such that an excessive counter-electromotive voltage does not occur in the inductor at the time of the shift. Therefore, application of a voltage higher than the withstand voltages to the transistor and other elements is prevented.

Preferably, the power supply device further includes: an input voltage determination circuit which refers to the DC input voltage and a lower limit of an operation voltage of the power supply device to determine the level of these voltages; a timer circuit which detects persistence for a predetermined time interval of a situation where the input voltage determination circuit determines that the DC input voltage is higher than the lower limit of the operation voltage and the output voltage determination circuit determines that the DC output voltage is lower than the DC input voltage; and a shutdown circuit which renders the transistor non-conducting when the timer circuit detects the persistence of the situation.

With the above features, when a short circuit or overload on the output side persists for a predetermined time interval, the power supply device is automatically shut down. Thus, the respective parts are protected from an overcurrent.

Another solution brought about by the present invention is a power supply device including: an inductor controlled by switching to be charged or discharged such that a DC input voltage is boosted; a capacitor which smoothes the boosted voltage to generate a DC output voltage; a transistor connected between the inductor and the capacitor to carry out a rectification function; an input voltage determination circuit which refers to the DC input voltage and a lower limit of an operation voltage of the power supply device to determine the level of these voltages; an output voltage determination circuit which refers to the DC input voltage and the DC output voltage to determine the level of these voltages; and a timer circuit which detects persistence for a predetermined time interval of a situation where the input voltage determination circuit determines that the DC input voltage is higher than the lower limit of the operation voltage and the output voltage determination circuit determines that the DC output voltage is lower than the DC input voltage; and a shutdown circuit which renders the transistor non-conducting when the timer circuit detects the persistence of the situation.

With the above features, when a short circuit or overload on the output side persists for a predetermined time interval, the power supply device is automatically shut down. Thus, the respective parts are protected from an overcurrent.

Specifically, the shutdown circuit renders the transistor non-conducting by supplying the DC input voltage to a gate of the transistor. Preferably, the shutdown circuit gradually changes the gate voltage of the transistor till the transistor is rendered non-conducting. Specifically, the shutdown circuit supplies the DC input voltage to the gate of the transistor via a resistor element. With these features, the shift from the overcurrent state to the shutdown state gradually progresses. Therefore, an excessive counter-electromotive voltage does not occur in the inductor at the time of the shift. Therefore, application of a voltage higher than the withstand voltages to the transistor and other elements is prevented.

Preferably, the shutdown circuit renders the transistor non-conducting when externally receiving a stop signal. With this feature, the power supply device can be arbitrarily shut down.

Preferably, the power supply device further includes a discharge circuit for discharging the capacitor during a period between start of a shutdown operation of the power supply device and determination by the output voltage determination circuit that the DC output voltage is higher than the DC input voltage. With this feature, the operation start conditions for the power supply device after the shutdown are uniform, such that startup errors and inrush current are prevented.

Preferably, the power supply device further includes a discharge circuit for discharging the capacitor when the DC output voltage is higher than a predetermined voltage. With this feature, occurrence of overvoltage on the output side is prevented.

DESCRIPTION OF THE PREFERRED EMBODIMENTS

Hereinafter, the best modes of practicing the present invention will be described with reference to the drawings.

Embodiment 1

Figure 1:
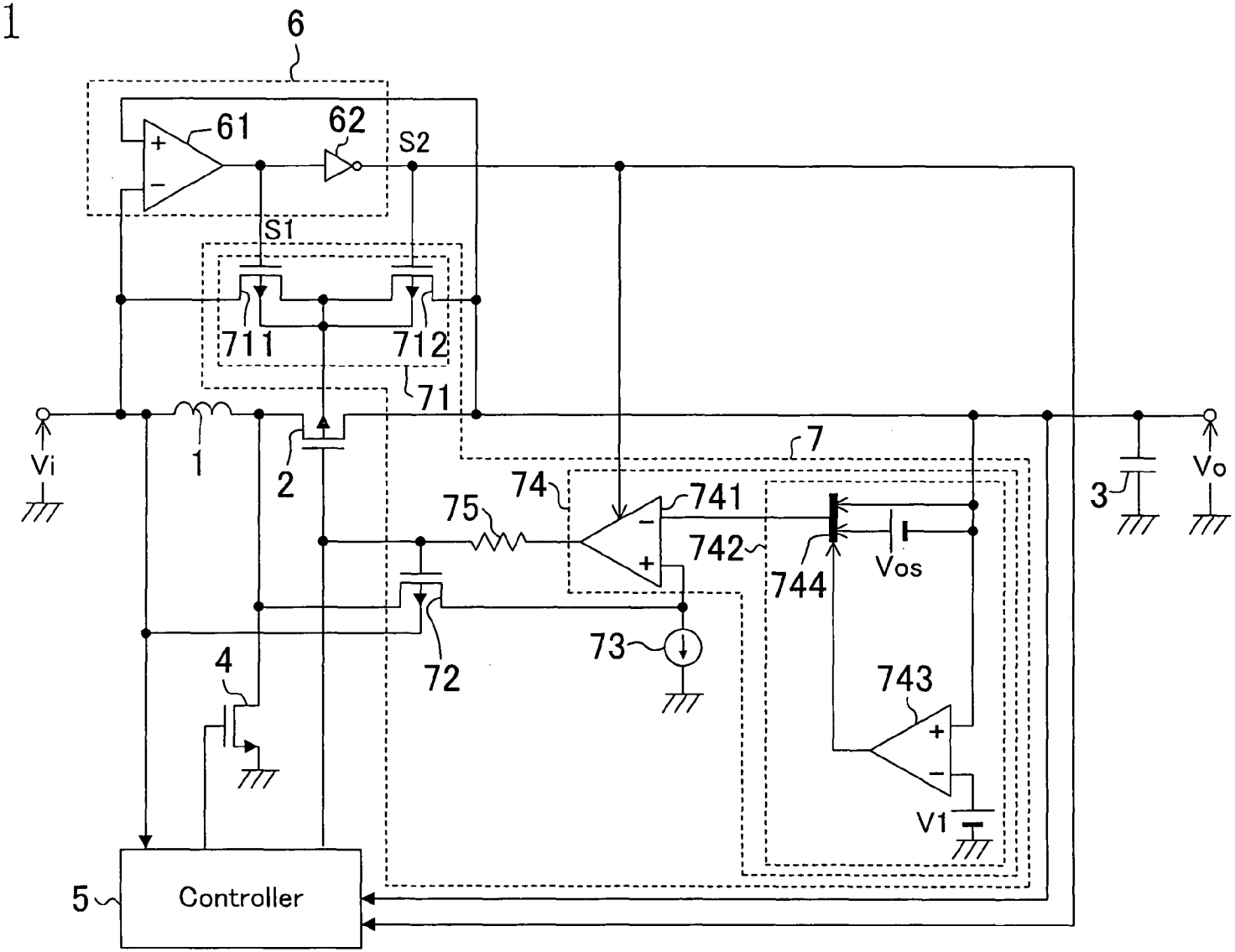
FIG. 1 is a circuit diagram of a power supply device according to embodiment 1 of the present invention.

FIG. 1 shows a circuit structure of a power supply device according to embodiment 1. One end of an inductor 1 is connected to an input terminal of DC input voltage Vi which is supplied from a battery, or the like. A transistor 2 is connected between the other end of the inductor 1 and the output terminal of DC output voltage Vo of this power supply device. This output terminal is connected to a capacitor 3 which smoothes voltage Vo. The transistor 2 carries out a rectification function by appropriate application of a bias and, furthermore, operates such that a current of a predetermined value flows therethrough. The transistor 2 can be realized by a PMOS transistor. A switching element 4 is connected between the other end of the inductor 1 and a reference voltage node. The switching element 4 can be realized by an NMOS transistor. Switching of the transistor 2 and switching element 4 are controlled by a controller 5.

An output voltage determination circuit 6 refers to voltages Vi and Vo to determine the level of these voltages. Specifically, the output voltage determination circuit 6 is formed by a comparator 61 and an inverter 62. The comparator 61 receives voltages Vi and Vo at an inversion input terminal and non-inversion input terminal, respectively, to output signal S1 which is indicative of a comparison result of these voltages. The inverter 62 logically inverts signal S1 to output signal S2. Therefore, when voltage Vo is lower than voltage Vi, signal S1 and signal S2 are "L" and "H", respectively. When voltage Vo is higher than voltage Vi, signal S1 and signal S2 are "H" and "L", respectively. It should be noted that the comparator 61 may have an offset such that, when voltage Vo is slightly lower than voltage Vi, signal S1 is "H".

A current control circuit 7 controls the current of the transistor 2 such that, when the output voltage determination circuit 6 determines that voltage Vo is lower than voltage Vi, a current flowing through the transistor 2 has a predetermined value. Specifically, the current control circuit 7 includes a backgate control circuit 71, an auxiliary transistor 72, a constant current source 73, a differential amplification circuit 74, and a resistor element 75.

The backgate control circuit 71 is formed by PMOS transistors 711 and 712 which are connected in series between the supply node of voltage Vi and the supply node of voltage Vo. The connection point of the transistors 711 and 712 is connected to the backgate of the transistor 2. The gates of the transistors 711 and 712 are connected to signal S1 and signal S2. When signal S1 and signal S2 are "L" and "H", respectively, the transistor 711 is turned on while the transistor 712 is turned off, so that voltage Vi is applied to the backgate of the transistor 2. When signal S1 and signal S2 are "H" and "L", respectively, the transistor 711 is turned off while the transistor 712 is turned on, so that voltage Vo is applied to the backgate of the transistor 2.

The gate and source of the auxiliary transistor 72 are connected to the gate and source of the transistor 2, respectively. The auxiliary transistor 72 has a size equal to 1/M of the transistor 2 (M is any positive number) and shares the gate electrode with the transistor 2. Preferably, voltage Vi is applied to the backgate of the auxiliary transistor 72. For example, the backgate of the auxiliary transistor 72 is connected to the input terminal of voltage Vi. Alternatively, the backgate of the auxiliary transistor 72 may be connected to the control output terminal of the backgate control circuit 71, i.e., the connection point of the transistors 711 and 712.

The differential amplification circuit 74 is formed by a differential amplifier 741 and an offset generation circuit 742. Specifically, the offset generation circuit 742 is formed by a comparator 743 and a selector 744. The comparator 743 receives voltages V1 and Vo at an inversion input terminal and non-inversion input terminal, respectively, to determine the level of these voltages. The selector 744 outputs any of voltage Vo and voltage Vo+Vos according to the output signal of the comparator 743. Namely, when voltage Vo is higher than voltage V1, the offset generation circuit 742 outputs voltage Vo. When voltage Vo is lower than voltage V1, the offset generation circuit 742 outputs voltage Vo plus offset voltage Vos. It should be noted that voltage Vos is set generally equal to the lower limit of the operation voltage of the constant current source 73.

The inversion input terminal of the differential amplifier 741 is connected to the offset generation circuit 742. The non-inversion input terminal of the differential amplifier 741 is connected to the constant current source 73 and the auxiliary transistor 72. The differential amplifier 741 operates on signal S2 used as the operation voltage. Therefore, when signal S2 is "H", the differential amplifier 741 outputs a voltage obtained by amplifying the difference between the voltages applied to the inversion input terminal and the non-inversion input terminal. The output voltage of the differential amplifier 741 is supplied to the gate connection point of the transistor 2 and the auxiliary transistor 72 via the resistor element 75. When signal S2 is "L", the differential amplifier 741 stops its operation so that the output of the differential amplifier 741 is rendered floating.

The controller 5 operates on voltage Vi used as the operation voltage to control switching of the transistor 2 and the switching element 4 based on signal S2 and voltage Vo. Specifically, when signal S2 is "L", the controller 5 applies a bias to the gate of the transistor 2 such that the transistor 2 functions as a rectifier and, meanwhile, controls the switching of the switching element 4 such that voltage Vo reaches a target value. When signal S2 is "H", the controller 5 is rendered floating. Accordingly, the switching element 4 is off so that the transistor 2 is controlled by the current control circuit 7.

Next, the operation of the power supply device of this embodiment at the times of startup, normal operation, and short-circuit or overload on the output will be described for the respective cases.

<<Operation at Startup>>

At the time of startup, voltage Vo is substantially zero. Therefore, voltage Vo is lower than voltage Vi so that signal S1 and signal S2 are "L" and "H", respectively. As a result, the backgate control circuit 71 applies voltage Vi to the backgate of the transistor 2. Since signal S2 is "H", the controller 5 is rendered floating, and the current control circuit 7 operates such that a current of a predetermined value flows through the transistor 2.

In the offset generation circuit 742, voltage Vo is lower than voltage V1 so that voltage Vo+Vos is output from the selector 744. The differential amplifier 741 supplies a voltage to the gate connection point of the transistor 2 and the auxiliary transistor 72 via the resistor element 75 such that the operation voltage of the constant current source 73 is equal to output voltage Vo+Vos of the offset generation circuit 742. As a result, a current flowing through the transistor 2 is M times the current allowed by the constant current source 73 to flow through the auxiliary transistor 72.

As described above, voltage Vo is substantially zero at the time of startup. Therefore, mere application of voltage Vo to the inversion input terminal of the differential amplifier 741 would cause the output of the differential amplifier 741 to be high level, so that the transistor 2 would be turned off, and the current of the transistor 2 could not be controlled. To avoid such a situation, the offset generation circuit 742 applies voltage Vo+Vos to the inversion input terminal of the differential amplifier 741 till voltage Vo reaches about voltage V1 such that the output of the differential amplifier 741 is at the low level, whereby the current control of the transistor 2 is enabled. This is the reason that offset voltage Vos is set generally equal to the lower limit of the operation voltage of the constant current source 73.

The flow of a current of a predetermined value through the transistor 2 causes charging of the capacitor 3 to progress. When voltage Vo exceeds voltage V1, the output of the comparator 743 is inverted. As a result, the selector 744 selects voltage Vos. At this point in time, the voltage applied to the inversion input terminal of the differential amplifier 741 decreases from voltage Vo+Vos to voltage Vo, and accordingly, the output voltage of the differential amplifier 741 increases, so that disturbance occurs in the current control of the transistor 2. However, the current control of the transistor 2 is stabilized when the operation voltage of the constant current source 73 decreases to reach voltage Vo.

It should be noted that the constant current which flows through the transistor 2 can be adjusted by appropriately setting the size of the auxiliary transistor 72. With this feature, the startup time can be adjusted to a desired value.

<<Operation During Normal Operation>>

The flow of a current of a predetermined value through the transistor 2 causes charging of the capacitor 3 to progress. When voltage Vo increases to about voltage V1, the output of the comparator 61 is inverted. As a result, signal S1 and signal S2 become "H" and "L", respectively. Accordingly, the backgate control circuit 71 applies voltage Vo to the back gate of the transistor 2. Since signal S2 is "L", the output of the differential amplifier 741 is rendered floating, so that the current control of the transistor 2 is ended. Instead, the controller 5 enters the normal operation mode to apply a bias to the gate of the transistor 2 such that the transistor 2 works as a rectifier and to control the switching of the switching element 4 with respect to voltage Vo as the target value.

<<Operation at Short-Circuit or Overload on Output>>

When a short-circuit or overload occurs on the output side during the normal operation of the power supply device of this embodiment, voltage Vo decreases. When voltage Vo decreases below voltage Vi, the output of the comparator 61 is inverted so that signal S1 and signal S2 become "L" and "H", respectively. Accordingly, the backgate control circuit 71 applies voltage Vi to the backgate of the transistor 2 so that the body diode of the transistor 2 becomes non-conducting. Since signal S2 is "H", the controller 5 is rendered floating, and the current control circuit 7 operates to control the current of the transistor 2. The details of the current control are as described above.

Thus, according to this embodiment, the current control is performed such that a current of a predetermined value flows at the times of startup and short-circuit or overload on the output. With this feature, the inductor 1 and the transistor 2 are protected from an inrush current or overcurrent. In particular, in the power supply device of this embodiment, only the inductor 1 and the transistor 2, which are the basic components of the step-up converter, are inserted in the current supply path. Therefore, the respective parts are effectively protected from an inrush current or overcurrent without any of occurrence of conduction loss and decrease of conversion efficiency.

It should be noted that the resistor element 75 can be omitted but is preferably located on the output side of the differential amplifier 741 as in the above-described structure for the following reason. The current which flows through the transistor 2 at the time of short-circuit or overload on the output is larger than that which flows during the normal operation. If in this circumstance the operation shifts to the current control carried out by the current control circuit 7, and if the drivability of the differential amplifier 741 is sufficiently high, the conduction state of the inductor 1 drops from the overcurrent to a constant current. This swift change of the current can lead to occurrence of a counter-electromotive voltage, which exceeds the withstand voltages of the transistor 2 and switching element 4, in the inductor 1. If with the resistor element 75, when the operation shifts to the current control carried out by the current control circuit 7, the gate voltage of the transistor 2 gradually changes according to the time constant determined by the gate parasitic capacitance of the transistor 2 and the resistor element 75. As a result, the conduction state of the inductor 1 gradually changes from the overcurrent to the constant current, and thus, the counter-electromotive voltage generated by this change of the current is suppressed to a low level.

If, contrary to the above case, the drivability of the differential amplifier 741 is low, a certain time period is consumed before a current of a predetermined value flows, during which the overcurrent continues to flow through the transistor 2. In the case where the drivability of the differential amplifier 741 is low, a lower limit clamp is provided such that the gate potential of the transistor 2 is generally equal to the threshold voltage as long as signal S2 is "H". With this feature, the overcurrent state is quickly exited so that a current of a predetermined value flows.

Embodiment 2

Figure 2:
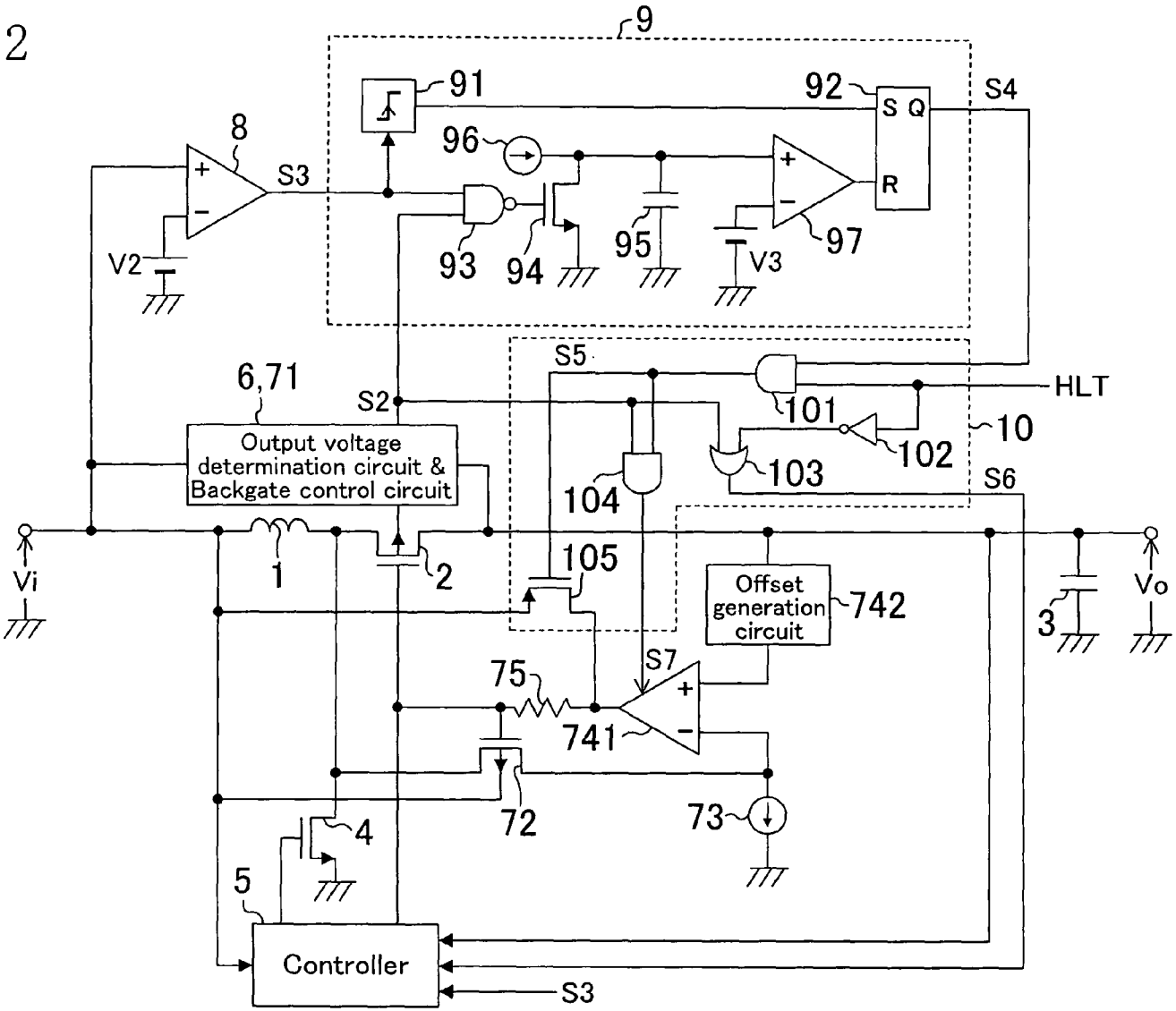
FIG. 2 is a circuit diagram of a power supply device according to embodiment 2 of the present invention.

FIG. 2 is a circuit diagram of a power supply device according to embodiment 2. The power supply device of this embodiment includes, in addition to the components of the power supply device shown in FIG. 1, an input voltage determination circuit 8, a timer circuit 9, and a shutdown circuit 10.

The input voltage determination circuit 8 refers to voltage Vi and voltage V2 to determine the level of these voltages. Specifically, the input voltage determination circuit 8 can be realized by one comparator. The comparator receives voltage Vi and voltage V2 at the inversion input terminal and the non-inversion input terminal, respectively, to output signal S3 which is indicative of a comparison result of these voltages. When voltage Vi is lower than voltage V2, signal S3 is "L". When voltage Vi is higher than voltage V2, signal S3 is "H". It should be noted that voltage V2 is set generally equal to the lower limit of the operation voltage of the power supply device of this embodiment.

The timer circuit 9 detects persistence of the situation where voltage Vi is higher than voltage V2 while voltage Vo is lower than voltage Vi for a predetermined time interval. Specifically, the timer circuit 9 includes an edge detector 91, an RS latch 92, an NAND gate 93, an NMOS transistor 94, a capacitor 95, a constant current source 96, and a comparator 97. When detecting a rising edge of signal S3, the edge detector 91 outputs a one-shot pulse to set the RS latch 92. The NAND gate 93 calculates the NAND of signal S2 and signal S3. Switching of the NMOS transistor 94 is controlled according to the output of the NAND gate 93.

Voltage V3 is applied to the inversion input terminal of the comparator 97. The non-inversion input terminal of the comparator 97 is connected to the NMOS transistor 94, the capacitor 95 and the constant current source 96. The output of the comparator 97 is a signal used for resetting the RS latch 92. When the NMOS transistor 94 is conducting, the capacitor 95 is discharged, and a reference voltage is applied to the non-inversion input terminal of the comparator 97. In this case, the output of the comparator 97 is "L", so that the RS latch 92 is not reset. When the NMOS transistor 94 is non-conducting, the capacitor 95 is charged by the constant current source 96, and the voltage of the charged capacitor 95 is applied to the non-inversion input terminal of the comparator 97. Thereafter, charging of the capacitor 95 progresses and, when the voltage of the charged capacitor 95 exceeds voltage V3, the output of the comparator 97 is "H" so that the RS latch 92 is reset.

The RS latch 92 outputs signal S4. When the RS latch 92 is set, signal S4 transitions to "H". When the RS latch 92 is reset, signal S4 transitions to "L". Namely, when voltage Vi is higher than voltage V2, signal S4 is "H". When the situation where voltage Vo is lower than voltage Vi lasts for a predetermined time interval, signal S4 transitions to "L". The predetermined time interval is determined according to the capacitance value of the capacitor 95, the magnitude of the current of the constant current source 96 and voltage V3, and can be appropriately adjusted by changing any of these factors. It should be noted that the predetermined time interval is set longer than the startup time of the power supply device of this embodiment, i.e., the time consumed between startup of the power supply device and increase of voltage Vo to about voltage Vi.

The shutdown circuit 10 operates based on signal S4 and signal HLT to render the transistor 2 non-conducting and stop the controller 5. Specifically, the shutdown circuit 10 includes an AND gate 101 which calculates the logical product of signal S4 and signal HLT to output signal S5, an inverter 102 which logically inverts signal HLT, an OR gate 103 which calculates the logical sum of the output of the inverter 102 and signal S2 to output signal S6, an AND gate 104 which calculates the logical product of signal S2 and signal S5 to output signal S7, and a PMOS transistor 105.

The source of the PMOS transistor 105 is connected to the supply node of voltage Vi, and the drain of the PMOS transistor 105 is connected to the output terminal of the differential amplifier 741. Therefore, when the PMOS transistor 105 is conducting, the output of the differential amplifier 741 is pulled up to voltage Vi so that the current control of the transistor 2 is stopped. It should be noted that the source of the PMOS transistor 105 may be connected to the control output terminal of the backgate control circuit 71.

Switching of the PMOS transistor 105 is controlled based on signal S5 input to the gate of the PMOS transistor 105. Namely, when signal S5 is "L", the PMOS transistor 105 is conducting. When signal S5 is "H", the PMOS transistor 105 is non-conducting. The differential amplifier 741 operates based on signal S7 used as the operation voltage. Namely, when signal S7 is "L", the output of the differential amplifier 741 is rendered floating. Therefore, when the timer circuit 9 detects persistence of the above-described predetermined situation for a predetermined time interval, or when signal HLT is set to "L", the output of the differential amplifier 741 is rendered floating and pulled up to voltage Vi, so that the current control of the transistor 2 is stopped.

In the case where signal HLT is set to "L", signal S6 is "H" irrespective of the level of signal S2. Therefore, the output of the controller 5 is rendered floating. When signal S3 is "L", the controller 5 stops its operation to turn both the transistor 2 and switching element 4 off. Meanwhile, the backgate control circuit 71 appropriately controls the backgate of the transistor 2 irrespective of the logical level of signal HLT.

Next, the shutdown operation of the power supply device of this embodiment which is carried out when signal HLT is "H" is described. After the power supply device is started, when voltage Vi exceeds voltage V2, output signal S3 of the input voltage determination circuit 8 becomes "H", so that a one-shot pulse is output from the edge detector 91, and the RS latch 92 is set. As a result, signal S4 becomes "H". Since voltage Vo is lower than voltage Vi at the time of startup, output signal S2 of the output voltage determination circuit 6 is "H". Since both signal S2 and signal S3 are "H", the output of the NAND gate 93 is "L", so that the NMOS transistor 94 is rendered non-conducting. Accordingly, the constant current source 96 starts charging the capacitor 95. At the same time, both signal S5 and signal S7 are "H", so that the PMOS transistor 105 is rendered non-conducting, and the current of the transistor 2 is controlled by the differential amplifier 741.

If there is no abnormality in external load, charging of the capacitor 3 leads to increase of voltage Vo. When the capacitor 3 reaches a vicinity of voltage Vi, signal S2 transitions to "L", whereby the current control of the transistor 2 is stopped, while the controller 5 enters the normal operation mode instead. However, if there is abnormality in external load, e.g., a short-circuit on the output side, voltage Vo does not increase. In this case, charging of the capacitor 95 progresses in the timer circuit 9. When the voltage of the charged capacitor 95 exceeds voltage V3, the RS latch 92 is reset, so that signal S4 transitions to "L". Accordingly, both signal S5 and signal S7 transition to "L" so that the PMOS transistor 105 is rendered conducting, and the output of the differential amplifier 741 is rendered floating. Since signal S2 stays at "H", the output of the controller 5 is also floating. Therefore, the charge accumulated in the gate parasitic capacitance of the transistor 2 is gradually released via the resistor element 75 till the transistor 2 is rendered non-conducting. Namely, the power supply device of this embodiment enters the situation where, if there is abnormality in external load, none of current control and boost control is performed while no current is supplied to the output side, i.e., the shutdown state. It should be noted that, after voltage Vi is decreased so that signal S3 transitions to "L" level, the shutdown state is maintained till voltage Vi is increased so that signal S3 transitions to "H" and the RS latch 92 is set.

The above-described shutdown operation is also carried out when the output side is short-circuited during the normal operation of the power supply device. Specifically, when voltage Vo decreases to be lower than voltage Vi, signal S2 transitions to "H" so that the current control of the transistor 2 is started. If voltage Vo does not increase to a vicinity of voltage Vi until detection by the timer circuit 9 of persistence of the above-described predetermined situation, it is determined that there is a short-circuit or overload on the output side, so that the shutdown operation is carried out. Accordingly, the backgate control circuit 71 applies voltage Vi to the backgate of the transistor 2 so that the transistor 2 is rendered non-conducting. As a result, supply of a current from the input side to the output side is interrupted.

As described above, according to this embodiment, when the output side is short-circuited or overloaded at the times of startup and normal operation, the power supply device is shut down. With this feature, the inductor 1 and the transistor 2 are protected from an overcurrent caused by abnormality in the output side. Further, the power supply device of this embodiment can be forcedly shut down by setting signal HLT to "L".

Embodiment 3

Figure 3:
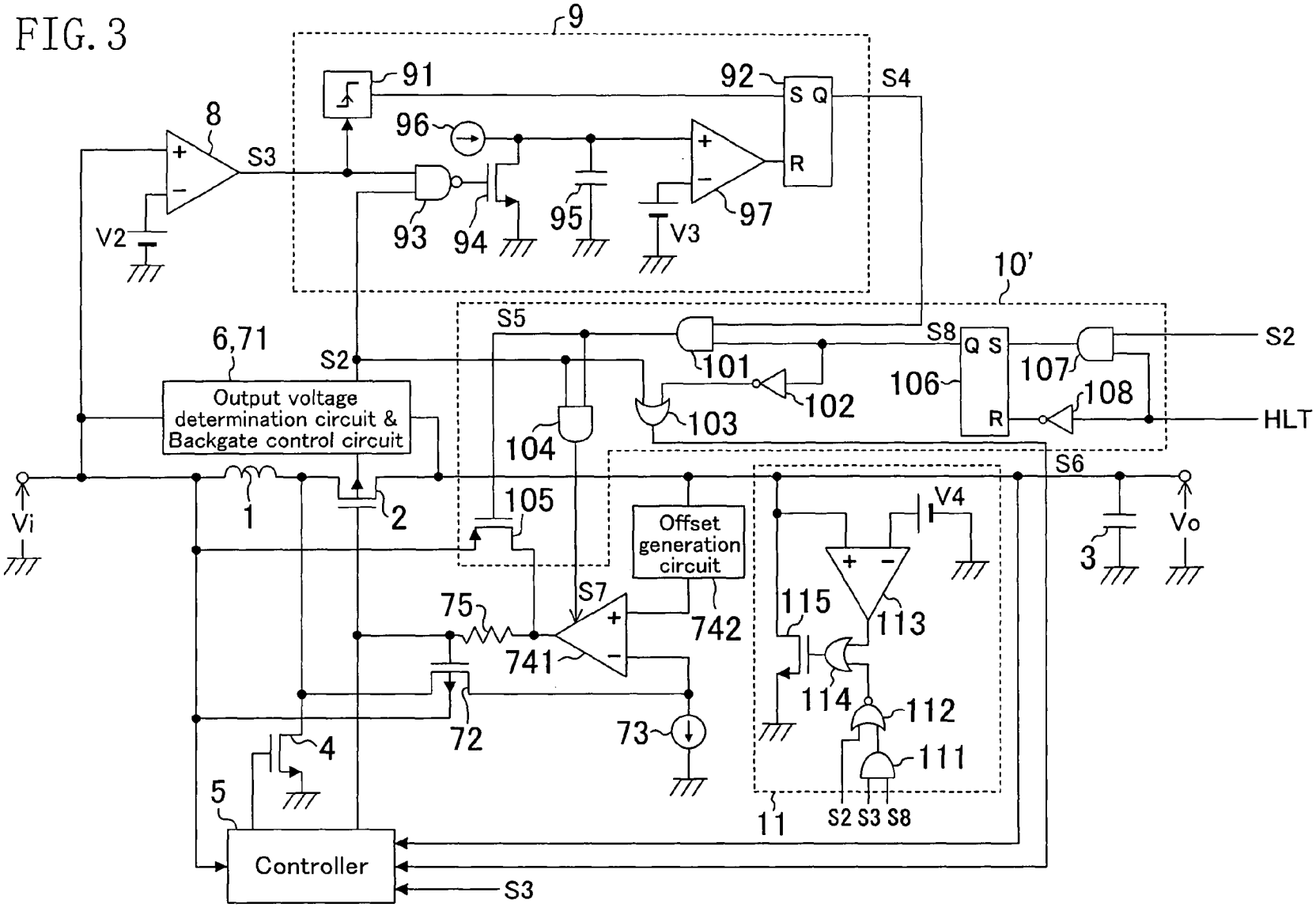
FIG. 3 is a circuit diagram of a power supply device according to embodiment 3 of the present invention.

FIG. 3 shows a circuit structure of a power supply device according to embodiment 3. The power supply device of this embodiment includes a discharge circuit 11 in addition to the component of the power supply device shown in FIG. 2 and a shutdown circuit 10' in place of the shutdown circuit 10.

The shutdown circuit 10' includes, in addition to the components of the shutdown circuit 10 shown in FIG. 2, an RS latch 106, an AND gate 107 which calculates the logical product of signal S2 and signal HLT to set the RS latch 106, and an inverter 108 which logically inverts signal HLT to reset the RS latch 106. Therefore, signal S8 output by the RS latch 106 is set to "H" when both signal S2 and signal HLT are "H". When signal HLT is "L", signal S8 is set to "L". Namely, after signal HLT is set to "L" such that the power supply device is forcedly shut down, signal S8 stays at "L" till signal S2 transitions to "H", i.e., till voltage Vo becomes lower than voltage Vi even if signal HLT is again set to "H". Thus, the shutdown operation is continued. It should be noted that the AND gate 101 calculates the logical product of signal S4 and output signal S8 of the RS latch 106. The inverter 102 logically inverts signal S8.

The discharge circuit 11 discharges the capacitor 3 based on signal S2, signal S3 and signal S8. Specifically, the discharge circuit 11 includes an AND gate 111 which calculates the logical product of signal S3 and signal S8, a NOR gate 112 which calculates the NOR of signal S2 and the output of the AND gate 111, a comparator 113, an OR gate 114 which calculates the logical sum of the output of the NOR gate 112 and the output of the comparator 113, and an NMOS transistor 115. The NMOS transistor 115 is connected between a capacitor 5 and a reference voltage node. Switching of the NMOS transistor 115 is controlled based on the output of the OR gate 114. Namely, when the NMOS transistor 115 is conducting, the capacitor 3 is discharged. Voltages V4 and Vo are applied to the inversion input terminal and non-inversion input terminal of the comparator 113, respectively. It should be noted that voltage V4 is set generally equal to the upper limit value of the output voltage of the power supply device of this embodiment. The NMOS transistor 115 has an ON-resistance which does not impose overload on the power supply device of this embodiment.

When signal S2 is "L" while any of signal S3 and signal S8 is "L", the output of the OR gate 114 is "H". Accordingly, the NMOS transistor 115 becomes conductive so that the capacitor 3 is discharged. Namely, when voltage Vo is lower than voltage Vi while voltage Vi is lower than voltage V2 or the forced shutdown operation is going on, the capacitor 3 is discharged so that voltage Vo decreases. When voltage Vo is higher than voltage V4, transition of the output of the comparator 113 to "H" leads to transition of the output of the OR gate 114 to "H", so that the NMOS transistor 115 becomes conducting, and the capacitor 3 is discharged. Namely, when voltage Vo exceeds voltage V4, the capacitor 3 is discharged so that voltage Vo decreases. As a result, the NMOS transistor 115 works as a kind of active dummy resistor such that, when voltage Vo is increased to be higher than voltage V4 due to, for example, a sudden decrease of load, the NMOS transistor 115 becomes conducting to decrease voltage Vo. Further, application of a voltage higher than the withstand voltage to the NMOS transistor 115 is prevented.

Next, the discharge operation of the power supply device of this embodiment is described. When signal HLT is set to "H" while voltage Vo is lower than voltage Vi and voltage Vi is higher than voltage V2, the power supply device of this embodiment starts the current control of the transistor 2.

Herein, when signal HLT is set to "L" or when voltage Vi decreases below voltage V2, the power supply device starts the shutdown operation. At this point in time, the output of the NOR gate 112 stays at "L" although the output of the AND gate 111 is "L" because signal S2 is "H" during a period where voltage Vo is higher than voltage Vi. Therefore, the NMOS transistor 115 also stays conducting so that discharging of the capacitor 3 continues. When voltage Vo reaches a vicinity of voltage Vi, signal S2 transitions to "L". As a result, the output of the NOR gate 112 transitions to "H" so that the NMOS transistor 115 becomes non-conducting, and discharging of the capacitor 3 is ended.

Thus, according to this embodiment, discharging of the capacitor 3 continues between the start of the shutdown operation of the power supply device and the increase of voltage Vo to the vicinity of voltage Vi. With this feature, the operation start conditions for the power supply device after the shutdown are uniform, such that startup errors and inrush current are prevented.

In the power supply devices of embodiments 2 and 3, if forced shutdown based on signal HLT is not performed, the circuit structure may be appropriately changed such that signal HLT is always "H". Specifically, the AND gate 101, the inverter 102 and the OR gate 103 can be omitted from the shutdown circuits 10 and 10'.

In each of the above-described embodiments, the components, such as comparators, inverters, etc., may operate based on voltage Vi used as the operation voltage. Alternatively, these components may operate based on a voltage supplied from the control output terminal of the backgate control circuit 71 which is used as the operation voltage. In this case, the higher one of voltage Vi and voltage Vo is supplied as the operation voltage.

What is claimed is:

1. A power supply device, comprising:

an inductor controlled by switching to be charged or discharged such that a DC input voltage is boosted;

a capacitor which smoothes the boosted voltage to generate a DC output voltage;

a transistor connected between the inductor and the capacitor to carry out a rectification function, said transistor having a current of a predetermined value flowing therethrough;

an output voltage determination circuit which refers to the DC input voltage and the DC output voltage to determine the level of these voltages; and a current control circuit which controls the current flowing through the transistor such that the current has the predetermined value when the output voltage determination circuit determines that the DC output voltage is lower than the DC input voltage.

2. The power supply device of claim 1, wherein the current control circuit includes:

a backgate control circuit which supplies the DC input voltage to a backgate of the transistor when the output voltage determination circuit determines that the DC output voltage is lower than the DC input voltage;

an auxiliary transistor whose source and gate are respectively connected to a source and gate of the transistor;

a constant current source connected to a drain of the auxiliary transistor; and a differential amplification circuit which receives a drain voltage of the transistor and a drain voltage of the auxiliary transistor to generate a voltage based on a difference between these received voltages and supplies the generated voltage to gates of the transistor and auxiliary transistor.

3. The power supply device of claim 2, wherein the differential amplification circuit includes:

an offset generation circuit which receives the DC output voltage and a predetermined voltage and which outputs a voltage equal to or higher than a lower limit of an operation voltage of the constant current source if the DC output voltage is lower than the predetermined voltage but outputs the DC output voltage if the DC output voltage is higher than the predetermined voltage; and a differential amplifier which receives the output voltage of the offset generation circuit and the drain voltage of the auxiliary transistor at an inversion input terminal and non-inversion input terminal, respectively, the differential amplifier having an output terminal connected to a gate connection point of the transistor and auxiliary transistor.

4. The power supply device of claim 2, wherein the current control circuit gradually changes the current flowing through the transistor to reach the predetermined value.

5. The power supply device of claim 4, wherein the current control circuit has a resistor element connected between the gate connection point of the transistor and auxiliary transistor and the differential amplifier circuit.

6. The power supply device of claim 1, further comprising:

an input voltage determination circuit which refers to the DC input voltage and a lower limit of an operation voltage of the power supply device to determine the level of these voltages;

a timer circuit which detects a state continuing for a predetermined time interval where the input voltage determination circuit determines that the DC input voltage is higher than the lower limit of the operation voltage and the output voltage determination circuit determines that the DC output voltage is lower than the DC input voltage; and a shutdown circuit which renders the transistor non-conducting when the timer circuit detects the state.

7. The power supply device of claim 6, further comprising a discharge circuit for discharging the capacitor during a period between start of a shutdown operation of the power supply device and determination by the output voltage determination circuit that the DC output voltage is higher than the DC input voltage.

8. A power supply device, comprising:

an inductor controlled by switching to be charged or discharged such that a DC input voltage is boosted;

a capacitor which smoothes the boosted voltage to generate a DC output voltage;

a transistor connected between the inductor and the capacitor to carry out a rectification function;

an input voltage determination circuit which refers to the DC input voltage and a lower limit of an operation voltage of the power supply device to determine the level of these voltages;

an output voltage determination circuit which refers to the DC input voltage and the DC output voltage to determine the level of these voltages; and a timer circuit which detects a state continuing for a predetermined time interval where the input voltage determination circuit determines that the DC input voltage is higher than the lower limit of the operation voltage and the output voltage determination circuit determines that the DC output voltage is lower than the DC input voltage; and a shutdown circuit which renders the transistor non-conducting when the timer circuit detects the state.

9. The power supply device of claim 8, wherein the shutdown circuit renders the transistor non-conducting by supplying the DC input voltage to a gate of the transistor.

10. The power supply device of claim 9, wherein the shutdown circuit gradually changes the gate voltage of the transistor till the transistor is rendered non-conducting.

11. The power supply device of claim 10, wherein the shutdown circuit supplies the DC input voltage to the gate of the transistor via a resistor element.

12. The power supply device of claim 8, wherein the shutdown circuit renders the transistor non-conducting when externally receiving a stop signal.

13. The power supply device of claim 12, further comprising a discharge circuit for discharging the capacitor during a period between start of a shutdown operation of the power supply device and determination by the output voltage determination circuit that the DC output voltage is higher than the DC input voltage.

14. The power supply device of claim 8, further comprising a discharge circuit for discharging the capacitor when the DC output voltage is higher than a predetermined voltage.

* * * * *